US007879142B2

(12) United States Patent
Han et al.

(10) Patent No.: US 7,879,142 B2
(45) Date of Patent: Feb. 1, 2011

(54) CYCLONE DUST COLLECTOR AND VACUUM CLEANER

(75) Inventors: Jung-gyun Han, Gwangju (KR); Joung-soo Park, Jeonbuk (KR); Byung-jo Lee, Gwangju (KR); Tae-gwang Kim, Gwangju (KR); See-hyun Kim, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 341 days.

(21) Appl. No.: 12/156,893

(22) Filed: Jun. 5, 2008

(65) Prior Publication Data

US 2009/0178567 A1 Jul. 16, 2009

Related U.S. Application Data

(60) Provisional application No. 61/011,343, filed on Jan. 16, 2008.

(30) Foreign Application Priority Data

Mar. 19, 2008 (KR) ..... 10-2008-0025614

(51) Int. Cl.
*B01D 50/00* (2006.01)

(52) U.S. Cl. ..... 96/381; 55/337; 55/343; 55/345; 55/346; 55/410; 55/413; 55/414; 55/415; 55/416; 55/DIG. 3; 55/529; 55/DIG. 21; 96/380; 96/382; 15/352; 15/353; 181/231

(58) Field of Classification Search ..... 15/353, 15/352; 96/380, 381, 382; 181/231; 55/337, 55/343, 345, 346, 410, 413–416, DIG. 3, 55/529, DIG. 21
See application file for complete search history.

(56) References Cited

U.S. PATENT DOCUMENTS 3,279,560 A * 10/1966 Hubrich ..... 181/247

(Continued)

FOREIGN PATENT DOCUMENTS

EP 1800587 6/2007

(Continued)

OTHER PUBLICATIONS

British Combined Search and Examination Report dated Dec. 19, 2008 corresponding to Application No. GB0816388.3.

*Primary Examiner*—Jason M Greene
*Assistant Examiner*—Dung Bui
(74) *Attorney, Agent, or Firm*—Ohlandt, Greeley, Ruggiero & Perle, LLP

(57) ABSTRACT

A cyclone dust collector includes a cyclone body including a first cyclone chamber to centrifugally separate dust from drawn-in air for a first time, a plurality of second cyclone chambers to centrifugally separate dust from the drawn-in air for a second time, and a plurality of discharge ports to cause the drawn-in air to be discharged from the plurality of second cyclone chambers; an upper cover to cover an upper portion of the cyclone body, the upper cover having an inner wall facing the plurality of discharge ports; and a noise reduction part disposed between the plurality of discharge ports and the inner wall of the upper cover, to reduce noise generated inside the upper cover by the air discharged through the plurality of discharge ports. Therefore, it is possible to reduce noise generated inside the upper cover of the cyclone dust collector.

20 Claims, 5 Drawing Sheets

U.S. PATENT DOCUMENTS

| | | | | |
|---|---|---|---|---|
| 6,344,064 | B1 | 2/2002 | Conrad | 55/337 |
| 6,626,984 | B1 * | 9/2003 | Taylor | 96/380 |
| 6,679,930 | B1 * | 1/2004 | An et al. | 55/337 |
| 7,416,575 | B2 * | 8/2008 | Oh et al. | 55/416 |
| 7,601,188 | B2 * | 10/2009 | Hwang et al. | 55/343 |
| 2002/0020035 | A1 * | 2/2002 | Illingworth | 15/346 |
| 2006/0037479 | A1 * | 2/2006 | Song et al. | 96/385 |
| 2006/0150587 | A1 * | 7/2006 | Hong et al. | 55/343 |
| 2007/0144116 | A1 * | 6/2007 | Hong et al. | 55/345 |
| 2007/0144117 | A1 * | 6/2007 | Park et al. | 55/345 |
| 2008/0155947 | A1 * | 7/2008 | Oh et al. | 55/345 |
| 2008/0264017 | A1 * | 10/2008 | Oh et al. | 55/457 |

FOREIGN PATENT DOCUMENTS

| | | |
|---|---|---|
| GB | 2418162 | 3/2006 |
| GB | 2445211 | 7/2008 |
| JP | 2003153840 | 5/2003 |
| KR | 1020010113182 | 12/2001 |
| KR | 1020050109199 | 11/2005 |
| KR | 1020070067791 | 6/2007 |
| KR | 1020070101056 | 10/2007 |

* cited by examiner

CYCLONE DUST COLLECTOR AND VACUUM CLEANER

CROSS-REFERENCE TO RELATED APPLICATIONS

This application claims the benefit under 35 U.S.C. §119 (e) of U.S. Provisional Patent Application No. 61/011,343, filed Jan. 16, 2008, in the United States Patent and Trademark Office, and claims the benefit under 35 U.S.C. §119(a) Korean Patent Application No. 10-2008-25614, filed on Mar. 19, 2008, in the Korean Intellectual Property Office, the entire disclosures of both of which are incorporated herein by reference.

BACKGROUND OF THE INVENTION

1. Field of the Invention

The present disclosure relates to a cyclone dust collector and a vacuum cleaner having the same, and more particularly, to a cyclone dust collector including a noise reduction part mounted between discharge ports of second cyclone chambers and an upper cover so as to reduce noise generated in the upper cover, and to a vacuum cleaner having the same.

2. Description of the Related Art

Vacuum cleaners are electronic devices which cause a suction force to be generated using electrical energy to draw in dust or dirt from a surface being cleaned and to remove the dust or dirt. Vacuum cleaners have been developed and used in a variety of structures and shapes, and, recently, vacuum cleaners having cyclone dust collectors to centrifugally separate dust or dirt from drawn-in air have become widely used.

FIG. 1 illustrates an example of a conventional cyclone dust collector. The cyclone dust collector of FIG. 1 includes a first cyclone chamber 10 and a plurality of second cyclone chambers 20. Drawn-in air flows into the first cyclone chamber 10 and is made to whirl inside the first cyclone chamber 10, so that relatively large dust is centrifugally separated from the drawn-in air and collected in a first collecting chamber 30 below the first cyclone chamber 10. Air from which the relatively large dust has been separated then flows into the plurality of second cyclone chambers 20 and is caused to whirl inside the plurality of second cyclone chambers 20, so that relatively fine dust is centrifugally separated from the air and collected in a second collecting chamber 40 below the second cyclone chambers 20.

Air from which the relatively fine dust has been separated by the plurality of second cyclone chambers 20 is discharged upwards through a plurality of second cyclone discharge ports 21 disposed above the second cyclone chambers 20. Subsequently, the air is discharged outwards from the cyclone dust collector through an air discharge opening 51 formed on an upper cover 50 which covers the upper portion of the cyclone dust collector.

However, the air from which the dust has been separated collides with an inner wall of the upper cover 50 prior to being discharged via the air discharge opening 51 of the upper cover 50, resulting in noise being generated. Such noise may cause users to experience auditory displeasure.

BRIEF SUMMARY OF THE INVENTION

The present disclosure has been developed in order to solve the above described and other problems in the related art. Accordingly, an aspect of the present disclosure is to provide a cyclone dust collector capable of reducing noise generated inside an upper cover by air discharged through discharge ports of second cyclone chambers, and a vacuum cleaner having the cyclone dust collector.

The above aspect is achieved by providing a cyclone dust collector including a cyclone body including a first cyclone chamber to centrifugally separate dust from drawn-in air for a first time, a plurality of second cyclone chambers to centrifugally separate dust from the drawn-in air for a second time, and a plurality of discharge ports to cause the drawn-in air to be discharged from the plurality of second cyclone chambers; an upper cover to cover an upper portion of the cyclone body, the upper cover having an inner wall facing the plurality of discharge ports; and a noise reduction part disposed between the plurality of discharge ports and the inner wall of the upper cover, to reduce noise generated inside the upper cover by the air discharged through the plurality of discharge ports.

The noise reduction part may include a noise-absorbing member to absorb noise generated inside the upper cover by the air discharged through the plurality of discharge ports.

The noise-absorbing member may be formed in a shape corresponding to the inner wall of the upper cover and may be attached to the inner wall of the upper cover.

The noise reduction part may further include a porous grill member disposed between the plurality of discharge ports and the noise-absorbing member, to prevent noise from being generated by the air discharged through the plurality of discharge ports.

A bottom surface of the noise-absorbing member may be supported by a top surface of the porous grill member.

The cyclone body may include a lower body including the first cyclone chamber, a first dust-collecting chamber to collect the dust separated by the first cyclone chamber, and a second dust-collecting chamber to collect the dust separated by the plurality of second cyclone chambers; an upper body connected to an upper portion of the lower body and having the plurality of second cyclone chambers; and a cyclone cover connected to an upper portion of the upper body and having the plurality of discharge ports. The noise reduction part may be mounted in an inner space formed between the inner wall of the upper cover and the cyclone cover.

The second dust-collecting chamber may include a horizontal chamber disposed in the upper portion of the lower body; and a vertical chamber disposed in a side of a lower portion of the lower body, the vertical chamber fluidly communicating with the horizontal chamber. The dust separated by the plurality of second cyclone chambers may be temporarily collected in the horizontal chamber and may automatically move towards the vertical chamber due to gravity so that the dust may be collected in the vertical chamber.

The cyclone dust collector may further include a lower cover disposed on the bottom of the lower body to be able to open or close the first dust-collecting chamber and the vertical chamber of the second dust-collecting chamber.

The above aspect is achieved by providing a vacuum cleaner including a cleaner main body having a vacuum source; a suction brush to draw in external air using a suction force generated by the vacuum source; and a cyclone dust collector detachably mounted in the cleaner main body to centrifugally separate dust from the drawn-in air. The cyclone dust collector may include a cyclone body including a first cyclone chamber to centrifugally separate dust from the drawn-in air for a first time, a plurality of second cyclone chambers to centrifugally separate dust from the drawn-in air for a second time, and a plurality of discharge ports to cause the drawn-in air to be discharged from the plurality of second cyclone chambers; an upper cover to cover an upper portion of the cyclone body, the upper cover having an inner wall facing the plurality of discharge ports; and a noise reduction part disposed between the plurality of discharge ports and the inner wall of the upper cover, to reduce noise generated inside the upper cover by the air discharged through the plurality of discharge ports.

The noise reduction part may include a noise-absorbing member to absorb noise generated inside the upper cover by the air discharged through the plurality of discharge ports.

The noise-absorbing member may be formed in a shape corresponding to the inner wall of the upper cover and may be attached to the inner wall of the upper cover.

The noise reduction part may further include a porous grill member disposed between the plurality of discharge ports and the noise-absorbing member, to prevent noise from being generated by the air discharged through the plurality of discharge ports.

A bottom surface of the noise-absorbing member may be supported by a top surface of the porous grill member.

The cyclone body may include a lower body including the first cyclone chamber, a first dust-collecting chamber to collect the dust separated by the first cyclone chamber, and a second dust-collecting chamber to collect the dust separated by the plurality of second cyclone chambers; an upper body connected to an upper portion of the lower body and having the plurality of second cyclone chambers; and a cyclone cover connected to an upper portion of the upper body and having the plurality of discharge ports. The noise reduction part may be mounted in an inner space formed between the inner wall of the upper cover and the cyclone cover.

The second dust-collecting chamber may include a horizontal chamber disposed lower portion of the lower body, the vertical chamber fluidly communicating with the horizontal chamber. The dust separated by the plurality of second cyclone chambers may be temporarily collected in the horizontal chamber and may automatically move towards the vertical chamber due to gravity so that the dust may be collected in the vertical chamber.

The vacuum cleaner may further include a lower cover disposed on the bottom of the lower body to be able to open or close the first dust-collecting chamber and the vertical chamber of the second dust-collecting chamber.

Therefore, according to the present disclosure, the noise reduction part may be mounted between the plurality of discharge ports of the plurality of second cyclone chambers and the upper cover, so it is possible to prevent noise from being generated inside the upper cover.

BRIEF DESCRIPTION OF THE SEVERAL VIEWS OF THE DRAWINGS

The above aspects and other advantages of the present disclosure will be more apparent by describing the present disclosure with reference to the accompanying drawing figures, in which.

Throughout the drawings, like reference numerals will be understood to refer to like parts, components and structures.

DETAILED DESCRIPTION OF THE INVENTION

Hereinafter, a vacuum cleaner according to an exemplary embodiment of the present disclosure will now be described in greater detail with reference to the accompanying drawing figures.

Figure 1:
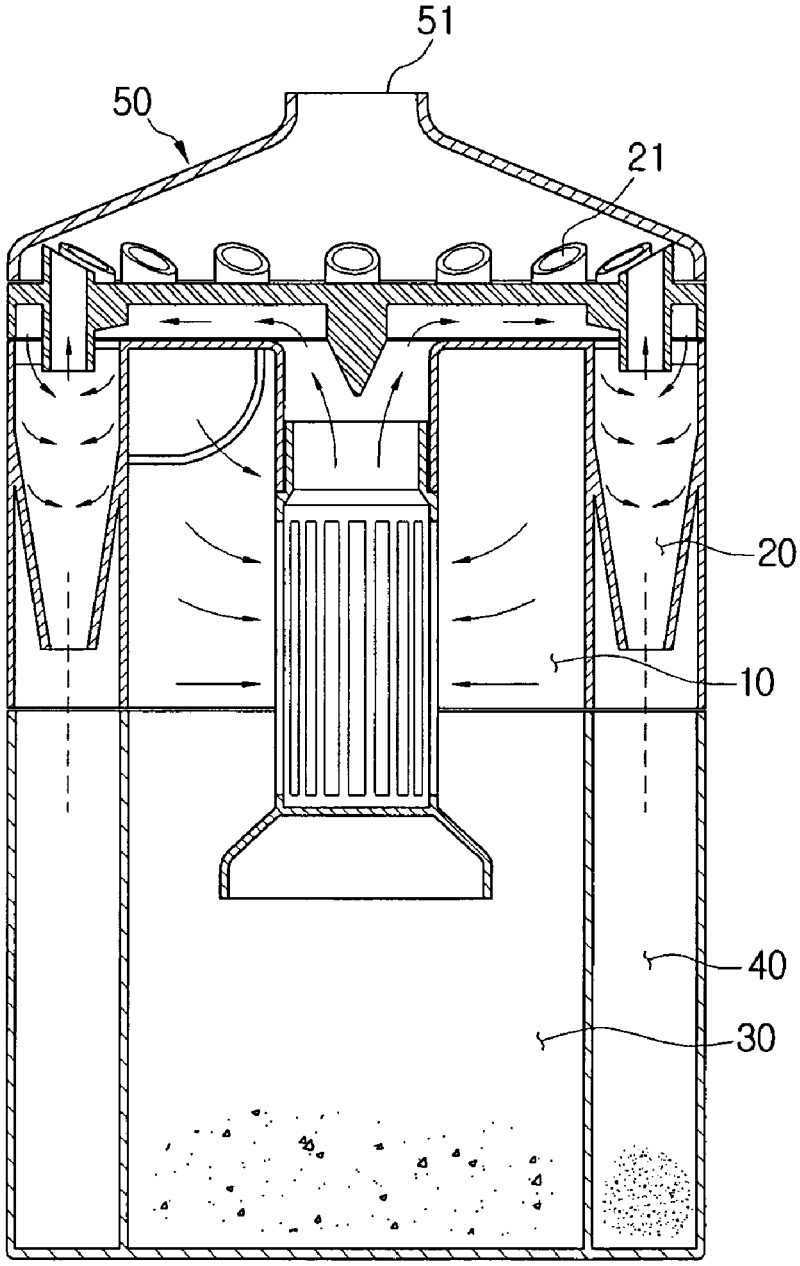
FIG. 1 (PRIOR ART)
FIG. 1 illustrates an example of a conventional cyclone dust collector.
Figure 2:
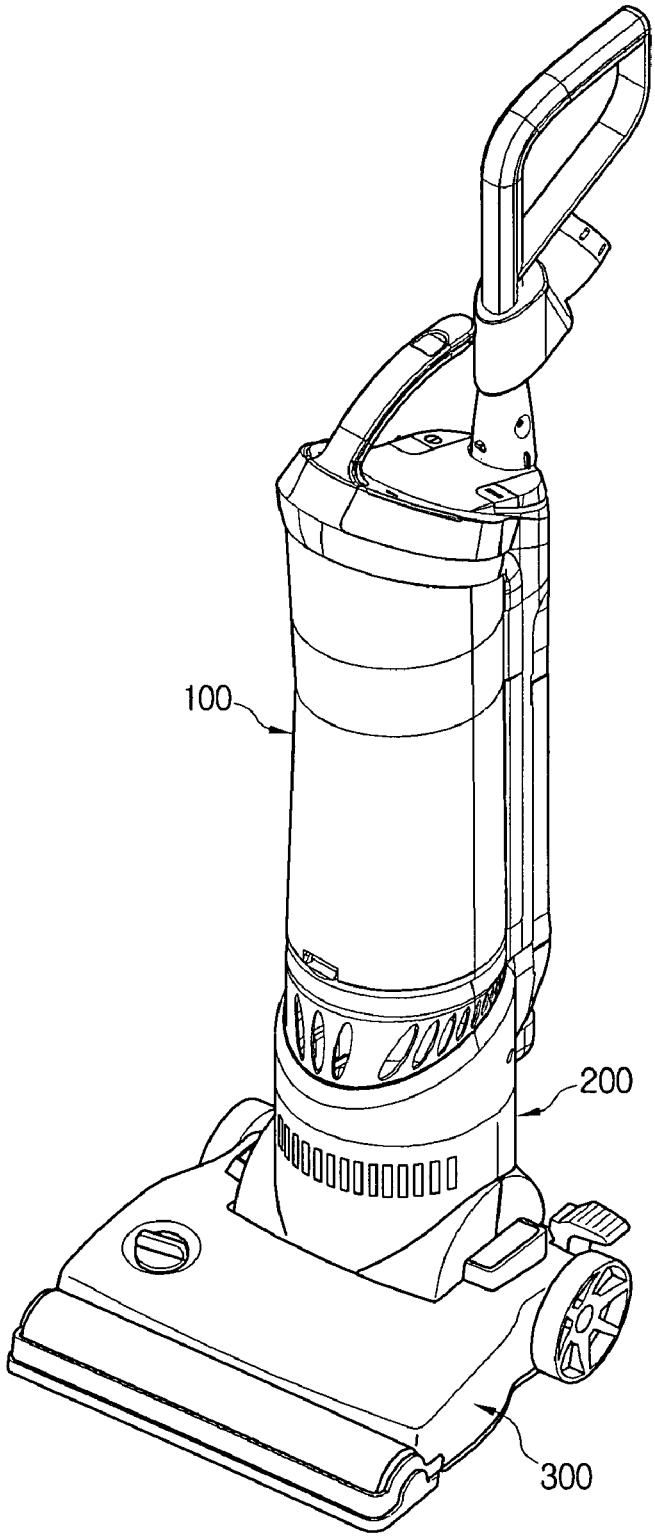
FIG. 2 is a perspective view of a vacuum cleaner.

Referring to FIG. 2, a vacuum cleaner according to an exemplary embodiment of the present disclosure includes a cleaner main body 200, a suction brush 300 and a cyclone dust collector 100.

The cleaner main body 200 includes a vacuum source (not illustrated) such as a suction motor disposed below the cyclone dust collector 100. The suction brush 300 is able to contact a surface being cleaned and to draw in external air containing dust or dirt (hereinafter, referred to as dust-laden air) from the surface being cleaned, using a suction force of the vacuum source. The cleaner main body 200 and suction brush 300 are orthogonal to each other generally, but if the cleaner main body 200 and suction brush 300 are operated, the cleaner main body 200 is inclined at an obtuse angle relative to the suction brush 300. The cyclone dust collector 100 centrifugally separates dust or dirt (hereinafter, referred to as dust) from air drawn in from the surface being cleaned by a cyclone scheme. The cyclone dust collector 100 is detachably mounted in the cleaner main body 200 so that dust collected inside the cyclone dust collector 100 can be easily discharged.

Figure 3:
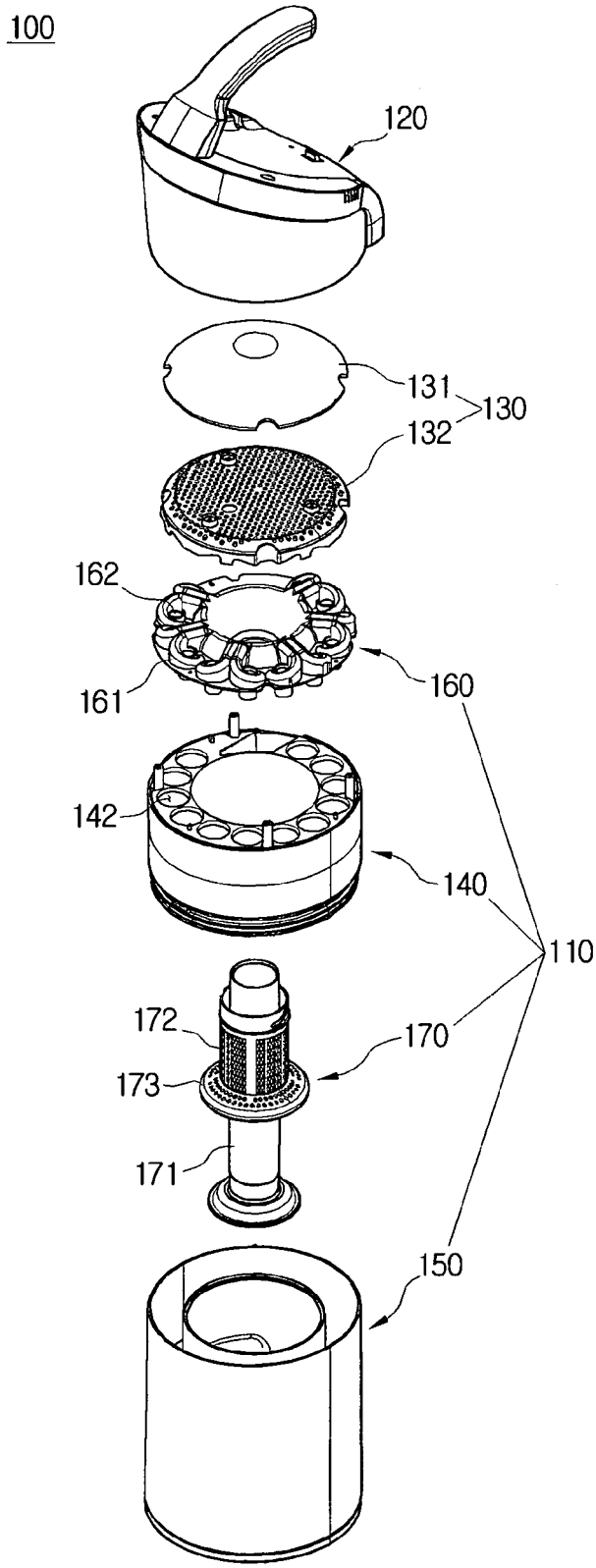
FIG. 3 is a partially exploded perspective view of the vacuum cleaner illustrated in FIG. 2.

Referring to FIG. 3, the cyclone dust collector 100 includes a cyclone body 110 to centrifugally separate dust or dirt from drawn-in air and collect the separated dust or dirt, an upper cover 120 to cover an upper portion of the cyclone body 110, and a noise reduction part 130 disposed between the cyclone body 110 and the upper cover 120 to reduce noise generated inside the upper cover 120 by the drawn-in air.

The cyclone body 110 of FIG. 3 includes an upper body 140, a lower body 150, a cyclone cover 160 and a discharge pipe assembly 170.

Figure 5:
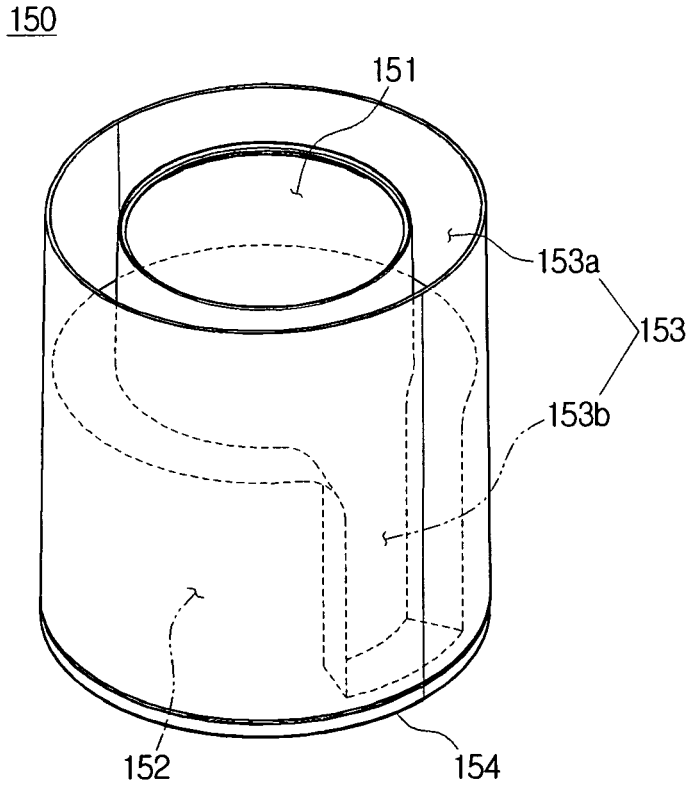
FIG. 5 is a perspective view of a lower body illustrated in FIG. 3.
Figure 6:
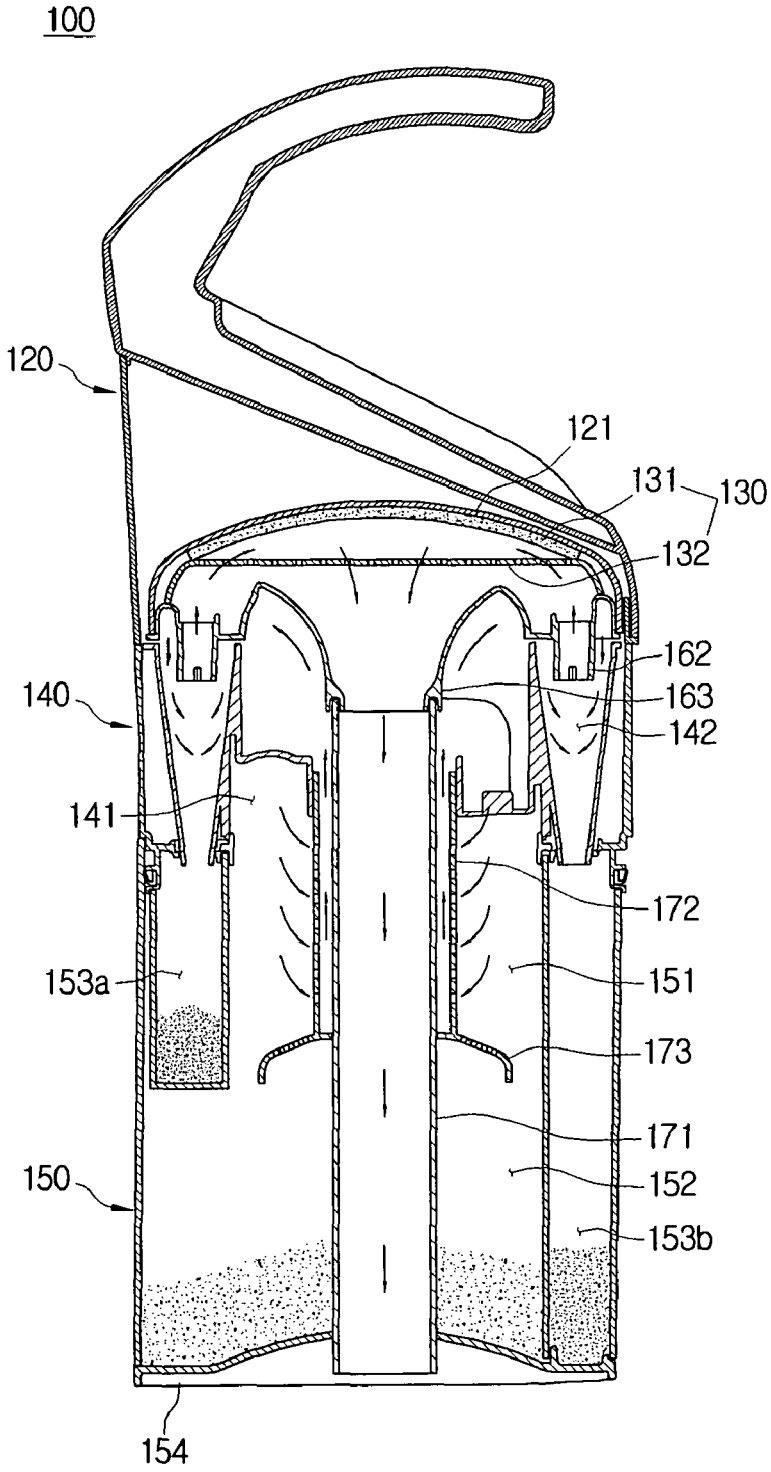
FIG. 6 is a sectional view of a cyclone dust collector illustrated in FIG. 2.

Referring to FIGS. 3, 5 and 6, the upper body 140 includes an air inlet port 141 and a plurality of second cyclone chambers 142. The lower body 150 includes a first cyclone chamber 151, a first dust-collecting chamber 152, a second dust-collecting chamber 153 and a lower cover 154.

Dust-laden air drawn in through the suction brush 300 flows into the first cyclone chamber 151 through the air inlet port 141. The first cyclone chamber 151 causes the drawn-in air to whirl downwards inside the first cyclone chamber 151, so that relatively large dust is centrifugally separated from the dust-laden air and collected in the first dust-collecting chamber 152 disposed below the first cyclone chamber 151. Air from which the relatively large dust has been separated then flows into the plurality of second cyclone chambers 142. Subsequently, the plurality of second cyclone chambers 142 cause the air to whirl downwards inside the plurality of second cyclone chambers 142, so that relatively fine dust is centrifugally separated from the air and collected in the second dust-collecting chamber 153 below the plurality of second cyclone chambers 142.

Referring to FIGS. 5 and 6, the first dust-collecting chamber 152 is formed in a substantially cylindrical shape and occupies most of the lower space of the lower body 150. The second dust-collecting chamber 153 includes a horizontal chamber 153*a*, which is disposed above the first dust-collecting chamber 152 and has a donut like shape of which a portion is cut away, and a vertical chamber 153*b*, which occupies some of the lower space of the lower body 150. The horizontal chamber 153*a* fluidly communicates with the vertical chamber 153*b*.

While the user uses the vacuum cleaner according to this exemplary embodiment, the cleaner main body 200 is disposed to be inclined with respect to the surface being cleaned. Accordingly, immediately after accumulating in the horizontal chamber 153*a*, the dust separated by the plurality of second cyclone chambers 142 automatically moves towards the vertical chamber 153*b* due to gravity. Since the second dust-collecting chamber 153 includes the horizontal chamber 153*a* and the vertical chamber 153*b*, the second dust-collecting chamber 153 may occupy less space in the lower body 150, so that it is possible to increase the space which the first dust-collecting chamber 152 is able to occupy in the lower body 150. This relative spatial extension of the first dust-collecting chamber 152 confers the advantage of increasing spatial efficiency in the lower body 150, because the first dust-collecting chamber 152 collects relatively large dust.

Additionally, referring to FIGS. 5 and 6, the lower cover 154 is hingedly connected to the bottom of the lower body 150. Accordingly, the user may separate the cyclone dust collector 100 from the cleaner main body 200, and may open the lower cover 154, so that dust collected in the dust-collecting chambers 152 and 153*b* may be easily discharged from the cleaner. Since the lower cover 154 is disposed on the bottom of the lower body 150 as described above, it is not necessary to separate the lower body 150 from the upper body 140 in order to discharge dust. Therefore, the lower body 150 may be fixed to the upper body 140.

Referring back to FIGS. 3 and 4, the cyclone cover 160 is connected to the top of the upper body 140. The cyclone cover 160 includes a plurality of flow channels 161. The plurality of flow channels 161 guide air discharged from the first cyclone chamber 151 toward corresponding second cyclone chambers 142.

Figure 4:
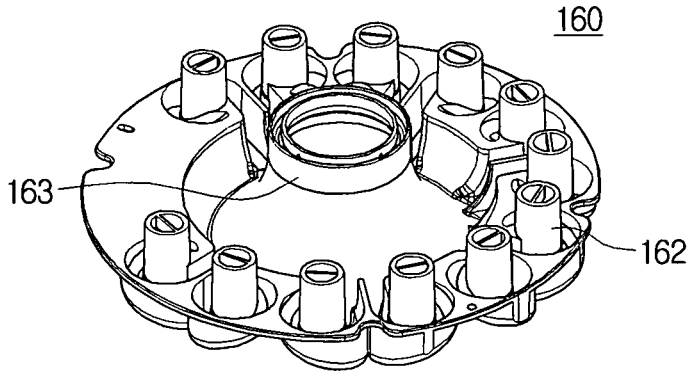
FIG. 4 is a perspective view of the bottom of a cyclone cover illustrated in FIG. 3.

Additionally, continuing to refer to FIGS. 3 and 4, the cyclone cover 160 includes a plurality of discharge ports 162 and a convergence section 163. Air from which dust has been separated by the plurality of second cyclone chambers 142 is discharged to the upper cover 120 through the plurality of discharge ports 162. The convergence section 163 is connected to a discharge pipe 171 (see FIG. 3), to collect the air discharged from the plurality of second cyclone chambers 142 and guide the air towards the discharge pipe 171.

Referring to FIGS. 3 and 6, the discharge pipe assembly 170 includes the discharge pipe 171, a grill 172 and a grill skirt 173. The discharge pipe 171 is disposed vertically along the center of the cyclone body 110, and the top end thereof fluidly communicates with the convergence section 163 of the cyclone cover 160 and the bottom end thereof fluidly communicates with the vacuum source in the cleaner main body 200. The grill 172 encloses an upper portion of the discharge pipe 171, and the bottom end thereof is connected to the grill skirt 173. The grill 172 has a plurality of pores, in order to remove some of the dust remaining in air which flows from the first cyclone chamber 151 to the inside of the grill 172. The grill skirt 173 prevents the dust collected in the first dust-collecting chamber 152 from flowing back upwards due to the whirling air flow.

Additionally, continuing to refer to FIGS. 3 and 6, the upper cover 120 is connected to the upper portion of the cyclone body 110, to cover the upper portion of the cyclone body 110. The upper cover 120 includes an inner wall 121 (see FIG. 6) disposed inside facing the plurality of discharge ports 162 of the plurality of second cyclone chambers 142. Therefore, air discharged from the plurality of second cyclone chambers 142 through the plurality of discharge ports 162 may collide with the inner wall 121 of the upper cover 120, which may cause noise to be generated.

The noise reduction part 130 includes a noise-absorbing member 131 and a porous grill member 132, as illustrated in FIGS. 3 and 6.

The noise-absorbing member 131 is formed in a shape corresponding to the inner wall 121 of the upper cover 120 and is attached to a bottom surface of the inner wall 121, as illustrated in FIG. 6. The noise-absorbing member 131 may be made of soft materials, such as polyurethane or polyester, which are capable of absorbing noise. Accordingly, the noise-absorbing member 131 may absorb noise generated inside the upper cover 120 due to the air discharged from the second cyclone chambers 142 through the discharge ports 162 so that the amount of audible noise may be reduced.

The porous grill member 132 is disposed between the noise-absorbing member 131 and the cyclone cover 160, as illustrated in FIG. 6. The porous grill member 132 has a plurality of pores spread over the entire surface thereof. The air discharged from the second cyclone chambers 142 through the discharge ports 162 passes through the porous grill member 132 prior to reaching the inner wall 121 of the upper cover 120 or the noise-absorbing member 131. While the air passes through the porous grill member 132 as described above, the noise generated inside the upper cover 120 can be partially prevented.

The noise-absorbing member 131 and porous grill member 132 are mounted between the upper cover 120 and the cyclone body 110, as described above, so it is possible to reduce the amount of noise generated inside the upper cover 120 by the air discharged from the second cyclone chambers 142 to the inside of the upper cover 120 through the discharge ports 162.

While the noise-absorbing member 131 is attached to the inner wall 121 of the upper cover 120 in this exemplary embodiment of the present disclosure, the present disclosure is equally applicable to a situation in which the noise-absorbing member 131 is supported by a top surface of the porous grill member 132 rather than being attached to the inner wall 121 when both the noise-absorbing member 131 and the porous grill member 132 are provided.

Hereinafter, operation of the vacuum cleaner according to the exemplary embodiment of the present disclosure constructed as described above will now be described in detail with reference to FIG. 6.

When a user starts cleaning a surface using the vacuum cleaner according to the present disclosure, dust-laden air on the surface being cleaned is drawn in through the suction brush. The drawn-in air flows into the first cyclone chamber 151 of the cyclone dust collector 100 via the air inlet port 141.

The first cyclone chamber 151 causes the drawn-in air to whirl downwards inside the first cyclone chamber 151, so that relatively large dust is centrifugally separated from the drawn-in air and collected in the first dust-collecting chamber 152 disposed below the first cyclone chamber 151. Air from which the relatively large dust has been separated then flows into the grill 172 on the center of the first cyclone chamber 151 and moves upwards. Subsequently, the air is guided to the inside of the plurality of second cyclone chambers 142 by the plurality of flow channels 161 (see FIG. 3) of the cyclone cover 160 (see FIG. 3).

The plurality of second cyclone chambers 142 cause the air to whirl downwards inside the plurality of second cyclone chambers 142, so that relatively fine dust is centrifugally separated from the air and collected in the horizontal chamber 153*a* of the second dust-collecting chamber 153 below the second cyclone chambers 142. Since the cyclone dust collector 100 is inclined with respect to the surface being cleaned in cleaning mode, the relative fine dust collected in the horizontal chamber 153*a* automatically moves towards the vertical chamber 153*b* of the second dust-collecting chamber 153 due to gravity.

Air from which the relatively fine dust has been separated in the second cyclone chambers 142 is discharged to the inside of the upper cover 120 through the plurality of discharge ports 162 above the second cyclone chambers 142. The discharged air collides with the inner wall 121 of the upper cover 120 and converges in the convergence section 163 of the cyclone cover 160.

When the air collides with the inner wall 121 of the upper cover 120, noise may be generated inside the upper cover 120, so the user may feel displeasure. However, the noise-absorbing member 131 attached to the inner wall 121 of the upper cover 120 absorbs the noise generated inside the upper cover 120. Additionally, the porous grill member 132 below the noise-absorbing member 131 causes the level of noise generated inside the upper cover 120 to be reduced to a level equal to or less than a predetermined level. As described above, according to the exemplary embodiment of the present disclosure, the noise reduction part 130 includes the noise-absorbing member 131 and porous grill member 132 which are disposed between the discharge ports 162 of the second cyclone chambers 142 and the inner wall 121 of the upper cover 120, so it is possible to reduce noise generated inside the upper cover 120.

Additionally, the air converging in the convergence section 163 of the cyclone cover 160 flows out from the cyclone dust collector 100 through the discharge pipe 171 connected to the cyclone cover 160, and is discharged outwards from the vacuum cleaner by the vacuum source (not illustrated) in the cleaner main body 200.

Although a representative exemplary embodiment of the present disclosure has been illustrated and described in order to exemplify the principle of the present disclosure, the present disclosure is not limited to the specific exemplary embodiment. It will be understood that various modifications and changes can be made by one skilled in the art without departing from the spirit and scope of the disclosure as defined by the appended claims. Therefore, it shall be considered that such modifications, changes and equivalents thereof are all included within the scope of the present disclosure.

What is claimed is:

1. A cyclone dust collector, comprising:

a cyclone body comprising a first cyclone chamber to centrifugally separate dust from drawn-in air for a first time, a plurality of second cyclone chambers to centrifugally separate dust from the drawn-in air for a second time, and a plurality of discharge ports through which the drawn-in air is discharged from the plurality of second cyclone chambers;

an upper cover to cover an upper portion of the cyclone body, the upper cover having an inner wall facing the plurality of discharge ports; and a noise reduction part disposed between the plurality of discharge ports and the inner wall of the upper cover, to reduce noise generated inside the upper cover by the discharge of air through the plurality of discharge ports, wherein the noise reduction part comprises a noise-absorbing member, the noise-absorbing member being formed in a shape corresponding to the inner wall of the upper cover.

2. The cyclone dust collector of claim 1, wherein the noise-absorbing member is attached to the inner wall of the upper cover.

3. The cyclone dust collector of claim 1, wherein the noise reduction part further comprises a porous grill member disposed between the plurality of discharge ports and the noise-absorbing member.

4. The cyclone dust collector of claim 3, wherein a bottom surface of the noise-absorbing member is supported by a top surface of the porous grill member.

5. The cyclone dust collector of claim 1, wherein the cyclone body comprises:

a lower body comprising the first cyclone chamber, a first dust-collecting chamber to collect the dust separated by the first cyclone chamber, and a second dust-collecting chamber to collect the dust separated by the plurality of second cyclone chambers;

an upper body connected to an upper portion of the lower body and having the plurality of second cyclone chambers; and a cyclone cover connected to an upper portion of the upper body and having the plurality of discharge ports, and wherein the noise reduction part is mounted in an inner space formed between the inner wall of the upper cover and the cyclone cover.

6. The cyclone dust collector of claim 5, wherein the second dust-collecting chamber comprises:

a horizontal chamber disposed in the upper portion of the lower body; and a vertical chamber disposed in a side of a lower portion of the lower body, the vertical chamber fluidly communicating with the horizontal chamber, and wherein the dust separated by the plurality of second cyclone chambers is temporarily collected in the horizontal chamber and automatically moves towards the vertical chamber due to gravity so that the dust is collected in the vertical chamber.

7. The cyclone dust collector of claim 6, further comprising a lower cover disposed on the bottom of the lower body to be able to open or close the first dust-collecting chamber and the vertical chamber of the second dust-collecting chamber.

8. A vacuum cleaner, comprising:

a cleaner main body having a vacuum source;

a suction brush to draw in external air using a suction force generated by the vacuum source; and a cyclone dust collector detachably mounted in the cleaner main body to centrifugally separate dust from the drawn-in air, wherein the cyclone dust collector comprises:

a cyclone body comprising a first cyclone chamber to centrifugally separate dust from the drawn-in air for a first time, a plurality of second cyclone chambers to centrifugally separate dust from the drawn-in air for a second time, and a plurality of discharge ports to cause the drawn-in air to be discharged from the plurality of second cyclone chambers;

an upper cover to cover an upper portion of the cyclone body, the upper cover having an inner wall facing the plurality of discharge ports; and a noise reduction part disposed between the plurality of discharge ports and the inner wall of the upper cover, to reduce noise generated inside the upper cover by the air discharged through the plurality of discharge ports, wherein the noise reduction part comprises a noise-absorbing member, the noise-absorbing member being formed in a shape corresponding to the inner wall of the upper cover.

9. The vacuum cleaner of claim 8, wherein the noise-absorbing member is attached to the inner wall of the upper cover.

10. The vacuum cleaner of claim 8, wherein the noise reduction part further comprises a porous grill member disposed between the plurality of discharge ports and the noise-absorbing member, to prevent noise from being generated by the air discharged through the plurality of discharge ports.

11. The vacuum cleaner of claim 10, wherein a bottom surface of the noise-absorbing member is supported by a top surface of the porous grill member.

12. The vacuum cleaner of claim 8, wherein the cyclone body comprises:

a lower body comprising the first cyclone chamber, a first dust-collecting chamber to collect the dust separated by the first cyclone chamber, and a second dust-collecting chamber to collect the dust separated by the plurality of second cyclone chambers;

an upper body connected to an upper portion of the lower body and having the plurality of second cyclone chambers; and a cyclone cover connected to an upper portion of the upper body and having the plurality of discharge ports, and wherein the noise reduction part is mounted in an inner space formed between the inner wall of the upper cover and the cyclone cover.

13. The vacuum cleaner of claim 12, wherein the second dust-collecting chamber comprises:

a horizontal chamber disposed in the upper portion of the lower body; and a vertical chamber disposed in a side of a lower portion of the lower body, the vertical chamber fluidly communicating with the horizontal chamber, and wherein the dust separated by the plurality of second cyclone chambers is temporarily collected in the horizontal chamber and automatically moves towards the vertical chamber due to gravity so that the dust is collected in the vertical chamber.

14. The vacuum cleaner of claim 13, further comprising a lower cover disposed on the bottom of the lower body to be able to open or close the first dust-collecting chamber and the vertical chamber of the second dust-collecting chamber.

15. A cyclone dust collector, comprising:

a cyclone body having an upper portion;

an upper cover having an inner wall, the upper cover being disposed on the cyclone body so that the inner wall faces the upper portion;

a noise-absorbing member having a shape corresponding to the inner wall and being attached to the inner wall; and a porous grill member disposed between the upper portion and the noise-absorbing member.

16. The cyclone dust collector of claim 15, wherein the cyclone body comprises:

an upper body having a plurality of second cyclone chambers, and having an upper portion;

a lower body having a first cyclone chamber, a first dust-collecting chamber, and a second dust-collecting chamber, the first dust-collecting chamber being configured to collect the dust separated by the first cyclone chamber and the second dust-collecting chamber being configured to collect the dust separated by the plurality of second cyclone chambers; and a cyclone cover having a plurality of discharge ports, the cyclone cover being connected to the upper body so that the plurality of discharge ports are defined at the upper portion of the cyclone body.

17. The cyclone dust collector of claim 16, wherein the second dust-collecting chamber comprises:

a horizontal chamber; and a vertical chamber fluidly communicating with the horizontal chamber so that the dust separated by the plurality of second cyclone chambers is temporarily collected in the horizontal chamber and moves to the vertical chamber due to gravity so that the dust is collected in the vertical chamber.

18. The cyclone dust collector of claim 17, further comprising a lower cover disposed on a bottom of the lower body, the cover selectively opening or closing the first dust-collecting chamber and the vertical chamber of the second dust-collecting chamber.

19. A cyclone dust collector, comprising:

a cyclone body comprising a first cyclone chamber to centrifugally separate dust from drawn-in air for a first time, a plurality of second cyclone chambers to centrifugally separate dust from the drawn-in air for a second time, and a plurality of discharge ports through which the drawn-in air is discharged from the plurality of second cyclone chambers;

an upper cover to cover an upper portion of the cyclone body, the upper cover having an inner wall facing the plurality of discharge ports; and a noise reduction part disposed between the plurality of discharge ports and the inner wall of the upper cover, to reduce noise generated inside the upper cover by the discharge of air through the plurality of discharge ports, wherein the noise reduction part comprises a porous grill member having a plurality of pores.

20. A vacuum cleaner, comprising:

a cleaner main body having a vacuum source;

a suction brush to draw in external air using a suction force generated by the vacuum source; and a cyclone dust collector detachably mounted in the cleaner main body to centrifugally separate dust from the drawn-in air, wherein the cyclone dust collector comprises:

a cyclone body comprising a first cyclone chamber to centrifugally separate dust from the drawn-in air for a first time, a plurality of second cyclone chambers to centrifugally separate dust from the drawn-in air for a second time, and a plurality of discharge ports to cause the drawn-in air to be discharged from the plurality of second cyclone chambers;

an upper cover to cover an upper portion of the cyclone body, the upper cover having an inner wall facing the plurality of discharge ports; and a noise reduction part disposed between the plurality of discharge ports and the inner wall of the upper cover, to reduce noise generated inside the upper cover by the air discharged through the plurality of discharge ports, wherein the noise reduction part comprises a porous grill member having a plurality of pores.

* * * * *